United States Patent [19]

Cobb et al.

[11] Patent Number: 5,054,954

[45] Date of Patent: Oct. 8, 1991

[54] ROADWAY BARRIER

[75] Inventors: Lincoln C. Cobb, Scarborough, Canada; Teddy J. Hirsch, College Station, Tex.

[73] Assignee: International Barrier Corporation, Toronto, Canada

[21] Appl. No.: 475,019

[22] Filed: Feb. 5, 1990

Related U.S. Application Data

[63] Continuation-in-part of Ser. No. 325,315, Mar. 16, 1989.

[51] Int. Cl.[5] ..... E01F 13/00

[52] U.S. Cl. ..... 404/6; 404/9; 256/13.1

[58] Field of Search ..... 404/6, 9, 10; 256/13.1, 256/19, 21; 188/32

[56] References Cited

U.S. PATENT DOCUMENTS

| | | | |
|---|---|---|---|
| Re. 29,544 | 2/1978 | Fitch . | |
| 376,936 | 1/1888 | Barton . | |
| 640,377 | 1/1900 | Haentges . | |
| 1,937,781 | 12/1933 | Patton . | |
| 2,919,045 | 12/1959 | Waugh et al. . | |
| 3,288,440 | 11/1966 | Schimmelpenninck . | |
| 3,317,189 | 5/1967 | Rubenstein | 256/13.1 |
| 3,643,924 | 2/1972 | Fitch . | |
| 3,856,268 | 12/1974 | Fitch . | |
| 3,880,404 | 4/1975 | Fitch . | |
| 3,916,816 | 11/1975 | Fitch . | |
| 3,967,704 | 7/1976 | Ogden | 188/32 |
| 3,983,956 | 10/1976 | Manhart . | |
| 4,073,483 | 2/1978 | Seegmiller . | |
| 4,075,473 | 2/1978 | Winston . | |
| 4,138,095 | 2/1979 | Humphrey . | |
| 4,290,585 | 9/1981 | Glaesener . | |
| 4,348,133 | 9/1982 | Trent et al. . | |
| 4,361,313 | 11/1982 | Russell . | |
| 4,423,854 | 1/1984 | Cobb et al. | 256/13.1 |
| 4,822,208 | 4/1989 | Ivey | 404/6 |
| 4,909,661 | 3/1990 | Ivey | 404/6 |

FOREIGN PATENT DOCUMENTS

| | | |
|---|---|---|
| 26682 | 3/1882 | Canada . |
| 21668 | 2/1885 | Canada . |
| 161947 | 2/1915 | Canada . |
| 189784 | 6/1918 | Canada . |
| 840107 | 4/1970 | Canada . |
| 1292156 | 4/1969 | Fed. Rep. of Germany . |
| 2317812.325 | 12/1973 | Fed. Rep. of Germany . |
| 2640910 | 3/1978 | Fed. Rep. of Germany . |
| 2908818 | 9/1979 | Fed. Rep. of Germany . |
| 776756 | 11/1934 | France . |
| 1393988 | 2/1965 | France . |
| 1588070 | 4/1970 | France . |
| 395442 | 7/1933 | United Kingdom . |
| 915133 | 1/1963 | United Kingdom . |
| 1055341 | 1/1967 | United Kingdom . |
| 1237445 | 6/1971 | United Kingdom . |
| 1298957 | 12/1972 | United Kingdom . |
| 1349076 | 4/1974 | United Kingdom . |
| 1364885 | 8/1974 | United Kingdom . |
| 1446152 | 8/1976 | United Kingdom . |
| 1474787 | 5/1977 | United Kingdom . |
| 1504926 | 3/1978 | United Kingdom . |
| 1560563 | 2/1980 | United Kingdom . |

OTHER PUBLICATIONS

Concrete Construction Handbook–2nd Edition (J. J. Waddell, Editor), Chapter 6, pp. 12–14 (Chapter 8).

Final Report of Department of Transportation of Dec. 1974, entitled "Molder Fiberglass Narrow Median Barrier"–R. M. Riddell.

*Primary Examiner*—William P. Neuder

*Attorney, Agent, or Firm*—Arnold, White & Durkee

[57] ABSTRACT

An elongated roadway barrier deformable under impact to redirect a vehicle striking the barrier. The barrier includes a plurality of panels arranged in parallel, spaced rows to define a filler cavity. A filler material is disposed in the cavity to support the barrier and to provide a medium for dissipating impact energy. The filler material is stabilized by a bonding agent and has a shear strength of at least about 30 psi and a compressive strength less than about 1200 psi.

39 Claims, 5 Drawing Sheets

ROADWAY BARRIER

This application is a continuation-in-part application of our co-pending application Ser. No. 07/325,315 filed Mar. 16, 1989.

This invention relates to a roadway barrier. More particularly, this invention relates to a roadway barrier component, to a method of forming a roadway barrier, and to a roadway barrier system.

The roadway barrier of this invention may serve particularly as a barrier for flanking a roadway or as a median barrier between adjacent roadways. It will be appreciated, however, that the barrier of this invention may have various other applications.

Roadway barriers are generally in the form of permanent installations such as heavy concrete barriers or metal guard rails. These present the disadvantage that repair and replacement as a result of impact damage is expensive and time consuming. In addition, these permanent installations do not lend themselves to dismantling and are therefore not suited for use as temporary removable barriers.

Additionally, each system has functional limitations which can lead to severe damage to impacting vehicles and to occupants of such vehicles.

Concrete barriers of the prevalent New Jersey profile type have been promoted as being effective in redirecting large conventional passenger vehicles without any undue tendency to overturn such vehicles. However, a distinct proportion will overturn and substantial vehicle damage can result due to rapid deceleration and sharp redirection by such barriers. Such concrete barriers have in full scale tests and in application, shown a tendency to overturn all automobiles, particularly smaller sized automobiles. As cars are downsized this overturning tendency shown by the New Jersey profile concrete median barrier will become a more commonly exhibited characteristic.

Steel guard rails can generally be designed to function reasonably well over a relatively narrow range of impact severity, based on vehicle size, weight, speed and angle of impact. They, however, can show alarming ramping tendencies under circumstances differing from the design ideal. Steel guard rail is also expensive to install, repair and maintain.

U.S. Pat. Nos. 4,423,854 and 4,361,313, which are assigned to the assignee of this application, relate to barrier systems which overcome many of the disadvantages of the prior systems as discussed. These two patents relate to roadway barriers which are deformable under vehicle impact to redirect vehicles coming into contact with them while absorbing impact energy. These roadway barriers are deformable by comprising pairs of opposed panels which are laterally spaced to house a particulate filler material between them. Under impact, the filler material can be displaced to absorb impact energy. Under larger impacts, the barrier can shift laterally to provide an additional impact energy absorption capability.

The roadway barriers of these two prior patents can present certain disadvantages in certain circumstances. These roadway barriers of the prior patents can sometimes present too little beam strength. This is particularly the case where severe impacts occur. Under severe impacts these barriers may have insufficient beam strength so that they have insufficient stability in shape. This can lead to twisting of the barrier under impact and to significant deformation of the barrier in the impact zone. This can also lead to a tendency for pocketing of the barrier to occur under impact. These barriers can also present a disadvantage when a large truck leans onto the barrier after an impact. Some of the barrier will usually have flattened and the barrier will have insufficient resistance to support the leaning truck.

It is accordingly an object of this invention to provide a system for reducing or overcoming at least some of these disadvantages.

In accordance with this invention there is provided an elongated roadway barrier positioned on a supporting surface to flank a roadway, the barrier being deformable under impact to redirect a straying vehicle striking the barrier, the barrier comprising:

(a) a plurality of panels arranged in two generally parallel spaced rows along lower edges of the panels to define a filler cavity between them;

(b) connection means engaged with the panels thereby locating the rows in their laterally spaced relationship, and connecting the panels in each row in end-to-end relationship in an elongated linked row with the barrier presenting an outer surface along at least a first side of the barrier which outer surface is generally smooth in a direction parallel to the length of the barrier to allow a vehicle striking the barrier to be deflected along the barrier;

(c) a filler material housed in the filler cavity to support the barrier and provide a medium for dissipating impact energy;

(d) the filler material being a stabilized filler material which is stabilized by means of a bonding agent;

(e) the stabilized filler material providing a shear strength for the stabilized filler material of at least about 10 to 15 psi to provide beam strength for the barrier to distribute an impact force along the length of the barrier; and (f) the stabilized filler material having a compressive strength of less than about 1200 psi to permit deformation of the barrier under impact to absorb impact energy.

Where the barrier is positioned along one side of a roadway, the first side of the barrier will comprise that side which faces the roadway.

On the other hand, where the barrier is positioned along the median between two adjacent roadways, then both the first side and the second side of the barrier will present outer surfaces which are generally smooth in a direction parallel to the length of the barrier to allow a vehicle striking either side of the barrier to be deflected along the length of the barrier.

In this embodiment of the invention, the panels along opposed sides of the barrier may conveniently be corresponding panels.

On the other hand, where only one side of a barrier is to be directed towards traffic on an adjacent roadway, then the panels on the side of the barrier which are remote from the roadway may differ from the panels facing the roadway. In this event such panels remote from the roadway may be panels which provide tensile strength under impact and which are not required to provide significant resistance to penetration under impact.

In a preferred embodiment of the invention, each panel which is positioned adjacent a roadway has a central impact zone which is bulged outwardly relatively to its upper and lower zones to form a primary impact zone.

The central impact zone may conveniently be positioned at a height where it will be engaged by an impacting vehicle of an average size to cause least damage to occupants of the vehicle and to provide the least tendency for causing ramping or overturning of impacting vehicles.

In a preferred embodiment of the invention, the central impact zone may comprise or may be defined by one or more corrugation formations which extend along the central impact zone.

In a preferred embodiment of the invention, each panel has an inturned lower flange approximate its lower edge to be directed inwardly during use. The lower flanges are preferably such that they are capable of being engaged by the filler material to thereby restrain lifting of the panels of the barrier under impact.

The lower flanges may extend towards each other to varying extents depending upon the type of supporting surface, the type of filler material, the types of vehicle impacts which are to be restrained and depending upon the extent to which lateral displacement of the impacted zone of the roadway barrier is required under vehicle impact.

The larger the surface areas of the lower flanges, the lesser will tend to be the frictional engagement of the barrier with its supporting surface, and therefore the greater will be the degree to which the roadway barrier can be displaced laterally under severe impacts.

The panels may have inwardly directed upper stiffening flanges along their upper edges. The barrier may also include elongated roof panels which close the upper surface of the barrier.

The connection means for connecting the panels in their laterally spaced relationship and for connecting the panels of the laterally spaced rows in end-to-end relationship, may be of any suitable and convenient type.

In some embodiments of the invention, the panels in each row may be simply bolted together in end-to-end relationship to provide the elongated rows of panels. The panels may be positioned in overlapping relationship with complementary connection holes through which connecting bolts can be inserted for bolting the panels together.

The connection means for connecting the panels of the opposed rows in laterally spaced relationship, may be of various types. Thus, for example, the connection means may be in the form of links, stays or bulkhead panels which are connected between the panels of the opposed laterally spaced rows.

Where bulkhead panels are employed, the bulkhead panels conveniently have their opposed edges shaped to accommodate the shape of the side panels in the opposed rows.

The stabilized filler material may be stabilized to provide an appropriate shear strength for the types of vehicle impacts which dictate primary design of the barrier for a particular roadway, while the barrier still retains a sufficient degree of deformability to absorb impact energy and thereby limit the extent of damage to an impacting vehicle and to occupants of the vehicle.

The filler material may be stabilized to provide a shear strength of at least about 15 to 30 psi. Alternatively, the filler material may be stabilized to provide a shear strength of at least about 40 psi.

In one preferred embodiment of the invention, the filler material may be stabilized to provide a shear strength of between about 40 psi and about 80 psi. In one presently most preferred embodiment of the invention, the filler material may be stabilized to provide a shear strength of between about 50 and about 70 psi, and most preferably between about 55 and about 65 psi.

The compressive strength of the stabilized filler material must be limited to provide a sufficient degree of yield under impact to absorb an adequate amount of impact energy.

Thus, for example, the stabilized filler material may have a compressive strength which is less than about 250 to 350 psi. With this type of compressive strength, the roadway barrier should yield a minimum of about 2 to 4 inches, and frequently 6–8 inches, under average vehicle impacts to provide an effective absorption of impact energy.

In alternative embodiments of the invention, the stabilized filler material is stabilized to have a compressive strength of less than about 150 to 200 psi.

In one presently preferred embodiment of the invention, the stabilized filler material has a compressive strength of less than about 125 psi.

Where truck traffic, and particularly heavy truck traffic, is expected to predominate in an area, then the filler material may preferably be stabilized to provide a higher shear strength, and a higher compressive strength.

Thus, for example, for heavy truck traffic, the filler material may be stabilized so that the stabilized filler material provides a compressive strength of between about 400 and about 1200 psi. A compressive strength in this range would thus provide a shear strength of about 65 psi to about 200 psi.

In a presently preferred embodiment for such conditions, the filler material should be stabilized so that the stabilized filler material provides a compressive strength of about 400 to about 800 psi, and most preferably of about 500 to 700 psi.

Such stabilized filler materials would typically provide shear strengths of between about 65 psi to about 135 psi, and about 85 psi to about 120 psi, respectively.

For roadway areas where the containment of trucks is important, but there are fewer of them in the traffic mix, then the filler material may be stabilized so that the stabilized filler materials provide compressive strengths of between about 200 and 400 psi.

Such a stabilized filler material would typically provide shear strengths of between about 30 and 65 psi.

In forming the stabilized filler material of this invention, the proportion of bonding agent must be sufficient to provide a sufficiently uniform distribution of the bonding agent through the filler material to provide a minimum shear strength in even the weakest zones of the stabilized filler material.

If the level of the bonding agent is too low, then the difficulty of obtaining a uniform shear strength along the length of the barrier particularly when considered in the light of the limited improvement in shear strength which will be provided by a low level of bonding agent, will mitigate against the use of a bonding agent.

The quantity of bonding agent should therefore be sufficient to provide for a sufficiently uniform distribution in practice, and to provide a meaningful shear strength which will increase the beam strength of the roadway barrier and thereby distribute impact energy over a larger length of the roadway barrier.

Where an appropriate beam strength is provided by the stabilized filler material, the roadway barrier will tend to be stabilized in its shape. It will therefore not tend to twist as severely under impact, and the curvature of deformation in the impact zone will be less extreme. This can provide the advantage that there will be less tendency for pocketing to occur under impact. Thus, smoother curves will encourage impacting vehicles to be more gradually and smoothly redirected along the length of the barrier thereby minimizing damage to impacting vehicles and to occupants of such vehicles.

By maintaining the compressive strength of the stabilized filler material below acceptable limits, the advantage can be achieved that impacting vehicles will not tend to be rapidly deflected back on to the roadway from whence they came. In addition, deformation of the stabilized filler material under impact will absorb impact energy and further reduce injury to vehicles and occupants of such vehicles. Furthermore, under severe impacts, after initial deformation has occurred, the roadway barrier in the impact zone can be displaced laterally to further absorb impact energy.

Because of the improved beam strength of the roadway barrier as provided by the shear strength of the stabilized filler material, a greater length of the roadway barrier will tend o come in to play under impact.

In addition, when such an appropriately stabilized filler material is used in a roadway barrier of this invention, it will tend to provide more support for a large vehicle such as a truck which leans upon the barrier during impact. The barrier will tend to provide better support for the weight of a truck than a barrier with a non-stabilized filler material.

By appropriately stabilizing the filler material, the area which is acted upon when a vehicle impact occurs, is increased. This can provide the advantage of further reducing any tendency for ramping to occur under impact.

The filler material may be any filler material which is suitable and economically available.

Conveniently, in constructing roadway barriers in accordance with this invention, filler materials will be used which are obtained from the locality where the roadway barrier is to be erected.

For most applications of this invention, the most appropriate filler materials are sand and other similar aggregates or fines.

Suitable cementitious material such as cement (e.g. white concrete, Portland) may be used as the bonding agent.

However, other bonding agents may be used depending upon the particular types of filler materials. For example, sodium silicate may be used as a bonding agent for filler materials of certain types.

Applicant believes that under certain conditions, synthetic resins may be used as bonding agents or as bonding agents supplements, for example. Such resins can be easily diluted for even distribution within the filler material.

In the roadway barrier of this invention, filler materials may be arranged in a plurality of elongated layers which extend along the length of the barrier.

In this embodiment of the invention, the layers may be arranged in generally or substantially vertically spaced layers or in generally or substantially horizontally spaced layers.

In this embodiment of the invention, some layers may be layers of non-stabilized filler material, whereas other layers may be layers of stabilized filler material. In this way beam strength can be provided in the regions where it is most needed, whereas non-stabilized filler materials can be provided in the regions where deformation is most needed to limit damage to vehicles and occupants of vehicles.

In the same way, filler materials stabilized to different extents can be used to provide differing shear strengths and differing compressive strengths in the differing layers.

Further, in accordance with the invention there is provided a method of improving the operating characteristics of a roadway barrier of the type comprising a plurality of panels which are arranged in two generally parallel spaced rows along their lower edges to define a filler cavity between them, with the panels being connected by means of connection means which locate the rows in their laterally spaced relationship and which connect the panels in each row in end-to-end relationship in an elongated linked row, with the barrier being deformable under impact to redirect a straying vehicle along the length of the barrier, the method comprising providing a stabilized filler material, in the filler cavity, the stabilized filler material providing a shear strength of at least about 10 to 15 psi and having a compressive strength of less than about 1200 psi.

The panels of this invention are preferably such that they allow deformation but resist penetration under the average type of impact which will be provided by an average vehicle during use.

In a preferred embodiment of the invention, the panels are made of mild steel sheet having a thickness of between about 9 and 20 gauge, and preferably have a thickness of between about 14 and 18 gauge.

The heights and lengths of the panels will be governed by roadway conditions, by vehicle speeds, and by the ease of handling and transportation of these panels.

In typical embodiments of the invention, the panels will have a height of between about $2\frac{1}{2}$ to $4\frac{1}{2}$ feet, and preferably $2\frac{1}{2}$ to $3\frac{1}{2}$ feet, a length of between about 6 and 12 feet, and the roadway barrier will be formed so that it has a width of between about 2 to 4 feet. In one presently preferred embodiment, the panels are made having a length of $11\frac{1}{2}$ feet. When they are erected in constructing a roadway barrier, the panels are overlapped by 1 foot. They therefore have an effective length of $10\frac{1}{2}$ feet in the erected barrier.

The roadway barrier of this invention may be provided with drainage conduits which extend through underneath the barrier at appropriately spaced interval. The roadway barrier may also be provided with vertically extending conduits or tubes for accommodating road signs, lighting fixtures, etc.

The roadway barrier of this invention may conveniently comprise a plurality of barrier components which are in effect positioned and connected to each other in end-to-end relationship. Each barrier component may therefore comprise a pair of opposed panels which are connected together in laterally spaced relationship, with the pair of panels of each component being connected in end-to-end relationship with corresponding pairs of panels of adjacent barrier components.

Preferred embodiments of the invention are now described by way of example with reference to the accompanying drawings.

Figure 1:
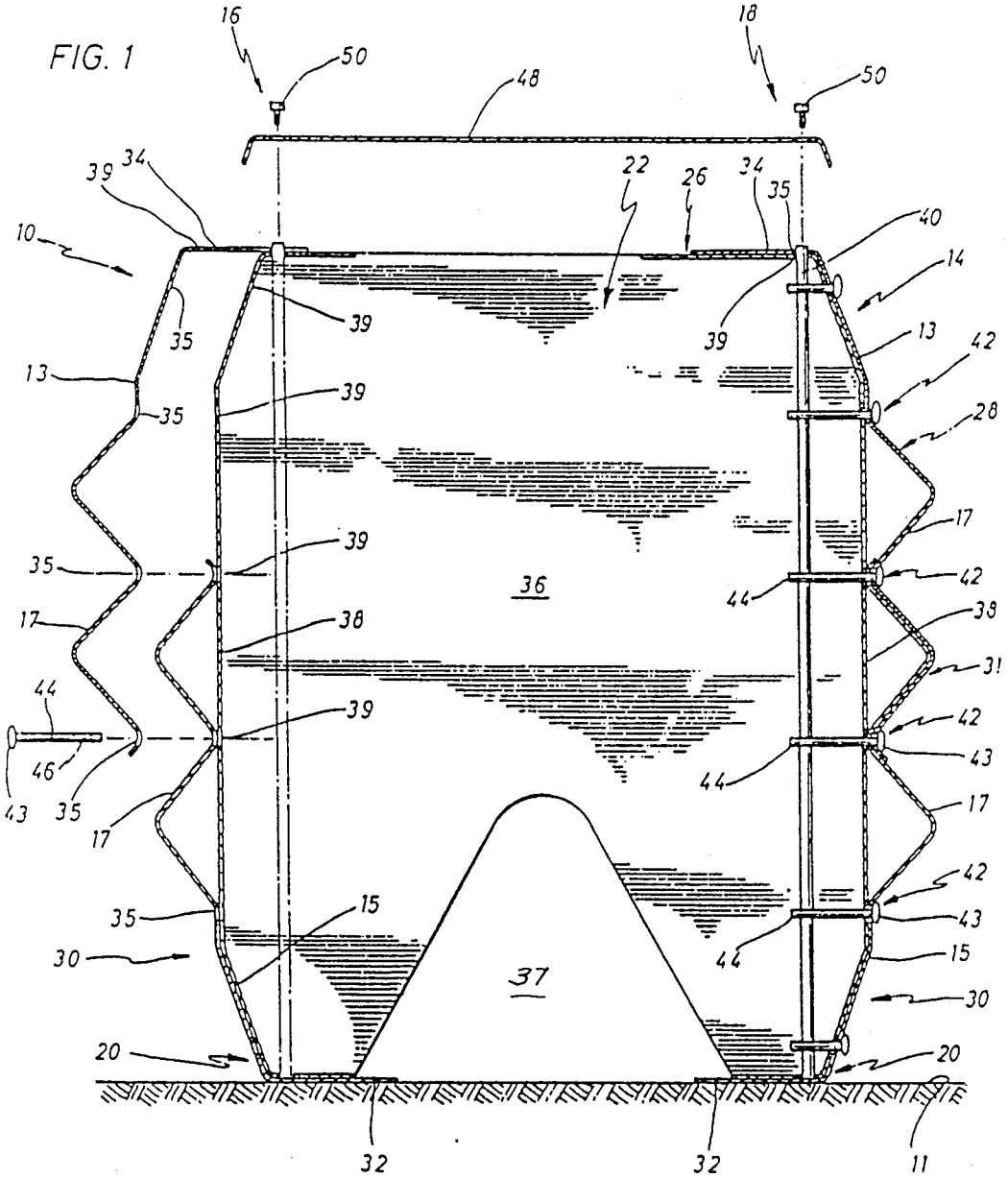
FIG. 1 shows a partly exploded, fragmentary end elevation of one embodiment of an assembled barrier component of a roadway barrier in accordance with this invention before being filled with a stabilized filler material.
Figure 2:
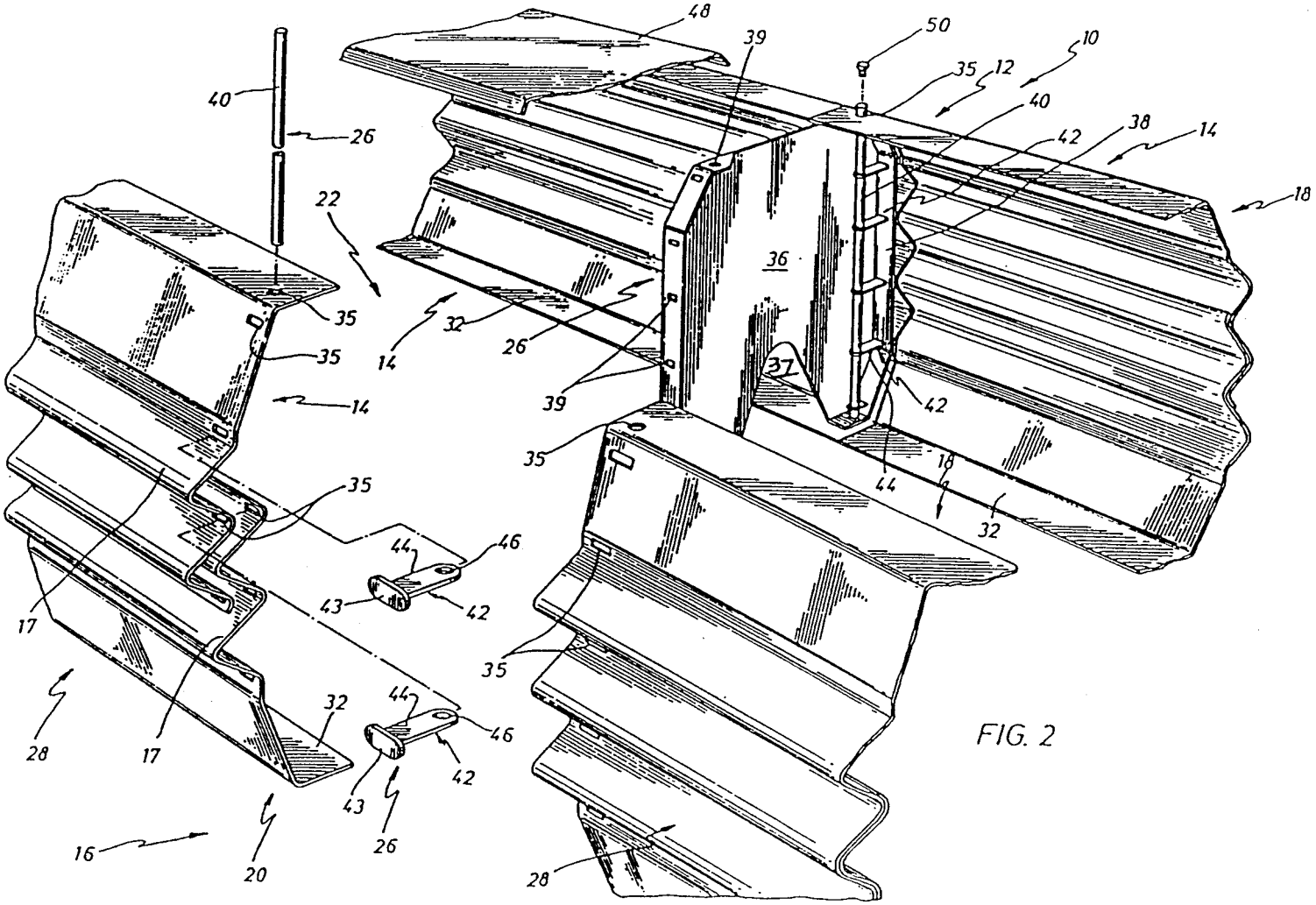
FIG. 2 shows a fragmentary, three-dimensional, partly exploded view of the barrier component of FIG. 1 with the lid or roof panel omitted for the sake of clarity.

With reference to FIGS. 1 and 2 of the drawings, reference numeral 12 refers generally to apparatus for forming on a supporting surface a barrier 12 for flanking a roadway.

The barrier 12 may be formed on the side of a roadway or, in the embodiment shown in the drawings, on the median between two adjacent highways to separate the highways.

The purpose of the barrier 12 is to deform under vehicle impact to absorb impact energy and to thus gradually deflect a straying vehicle coming into contact therewith. The barrier 12 is designed to redirect a vehicle sufficiently slowly with a view to minimizing damage caused to such a vehicle and injury caused to its occupants. In the preferred embodiment of the invention, the barrier 12 is such that it will be deformed under low impact conditions such as by a small vehicle or by a vehicle travelling at a relatively low speed, but will be capable of being displaced laterally after deformation under high impact conditions to better absorb high impact energy.

The barrier 12 has the further object of preventing a vehicle striking the barrier from being deflected over the barrier onto the other highway or from being deflected rapidly back onto the highway on which it originally was, thereby reducing the risk of further collision with other vehicles.

Since roadside space is usually limited, particularly in the case of a median, the extent to which the barrier 12 can be displaced laterally under impact should be limited. On the other hand, unless the barrier can be shifted laterally under impact, it cannot usually absorb high impact energy sufficiently slowly to limit damage to impacting vehicles and the occupants of such vehicles within acceptable limits, and will usually tend to deflect impacting vehicles rapidly and hazardously back onto the roadway, or allow vehicles to penetrate or vault the barrier with further hazardous consequences.

It follows therefore that in the preferred embodiment of the invention, to provide adequately for high and low impact conditions, presented by the size of vehicle, the speed of impact and the angle of incidence, the barrier should be resistant to displacement under low impact conditions, and should be displaceable under high impact conditions with the extent of displacement restrained both initially and during displacement.

These objectives are achieved in accordance with this invention by having the panels of the barrier components laterally spaced from each other, and by having the ballast material between the panels resting on and engaging with the supporting surface, or engaging with sheet material resting on the supporting surface.

The frictional engagement between the ballast material and the supporting surface will provide the necessary resistance during displacement both when the barrier is at rest, and while the barrier is being displaced laterally under impact.

The barrier 12 comprises a plurality of panels 14 which are adapted to be arranged in barrier component pairs in two generally parallel spaced rows 16 and 18 as shown in FIG. 1 along lower edges 20 of the panels 14 on a supporting surface 11 to define a filler cavity 22 between them for housing a filler material (not shown in FIGS. 1–2) to provide a medium for dissipating impact energy during use and to support the barrier components and the barrier 12 when formed. The apparatus 10 further comprises panel connection means 26 to be engaged with the panels 14 to locate two such rows 16 and 18 in their laterally spaced relationship, and to connect the panels 14 in each row in end-to-end relationship to form an elongated linked row as shown in FIG. 2.

The panels 14 are adapted, when connected in the rows 16 and 18, to present outer surfaces 28 which are smooth and free of outwardly projecting obstructions in at least one direction parallel to the length of each linked row 16 and 18.

The panels are thus assembled so that the outer surface 28 of each row will be smooth in the direction of traffic flow on the adjacent, highway flanked by that row.

The barrier 12 is further such that when the panels 14 have been assembled and when filler material is housed in the filler cavity 22, the barrier 12 will provide a lower zone 30 adjacent the lower edge 20, which provides a lesser impact resistance under impact than a central impact zone 31 of each row above the lower zone 30. Each panel 14 is formed out of 14 gauge mild steel sheet which is such that it allows deformation of the panel but will resist penetration of the panel under the average type of impact which will be provided by a vehicle during use. Applicant believes, however, that other materials, such as synthetic plastics materials, resin impregnated materials, composites and the like may also be used.

Each panel 14 comprises an upper panel section 13 and a lower panel section 15, with each panel section having corrugating formation 17 along one elongated edge zone. The corrugating formations 17 of the upper and lower panels 13 and 15 are overlapped to form the panels 14 and to form the central impact zones 31 which are thus reinforced in the primary impact zones 31 by the corrugating formations and also by the overlap of the corrugating formations 17.

As shown in the drawings, the upper and lower panel sections 13 and 15 are preferably corresponding panel sections so that any panel section may be used either as an upper panel section 13 or a lower panel section 15.

It will be appreciated, however, that the upper and lower panel sections 13 and 15 may differ, in which case different upper and lower panel sections will have to be manufactured. Differing upper and lower panel sections 13 and 15 may be required for a particular application of the invention such as, for example, where a barrier component of increased height while still presenting a relatively low central impact zone 31 is required.

As shown in the drawings, each panel 14 has its central impact zone 31 bulged outwardly relatively to its upper zone and relatively to its lower zone 30.

This provides the advantage that an average vehicle which strikes the barrier 12, will strike against the central impact zone 31 to deform the panels 14 in that zone before coming into contact with either the upper zone or the lower zone 30 of the panel.

This provides certain substantial advantages for the barrier illustrated in the drawings.

By having the lower zone of each panel 14 recessed relatively to its central impact zone 31, the width of the upper portion of the barrier 12 is reduced relatively to its width in the central impact zone 31. This provides the advantage that the stability of the barrier 12 under impact is improved and that the center of gravity of the barrier 12 can more easily be provided at or near the height of the center of gravity of typical automobiles. Because of this and because contact between the lower zone of the barrier 12 and an impacting vehicle is delayed until the central impact zone 31 has been deformed by the impact, the lower zone will provide a lesser impact resistance to an impacting vehicle since the speed of the vehicle will have been attenuated by the impact before the vehicle comes into contact with the lower zone of the barrier 12.

There will therefore be a lesser tendency for contact between the tires of an impacting vehicle and the lower zone of the barrier 12, and therefore a reduced tendency to elevate and/or overturn the vehicle. This arrangement will therefore encourage lateral displacement of the barrier under high impact with the barrier remaining substantially vertical, thereby combatting the tendency for an impacting vehicle to ride over the barrier.

Because of these advantages, even if the upper panel section 13 does not correspond to the lower panel section 15, the lower panel section 15 will still be manufactured so as to provide the recessed lower zone 30 relatively to the central impact zone.

The recessed lower zone 30 provides a significant advantage for the barrier 12 illustrated in FIGS. 1 and 2 of the drawings.

An average passenger vehicle usually has its center of gravity at a height of between about 15 and 25 inches. When such a vehicle strikes a roadway barrier, the point of maximum impact is therefore spaced above the base of the barrier.

Therefore, if the lower region of the barrier below the point of impact presents an impact resistance which is the same as or greater than the impact resistance provided by the impact zone of the barrier, an impact will usually tend to cause displacement or deformation of the lower region of the barrier in a direction outwardly away from the barrier relatively to the direction of displacement or deformation of the central impact zone of the barrier.

Such relative displacement will give rise to the lower portion of the barrier being deformed into a ramp relatively to the remainder of the barrier. Such a ramp will have the effect of tending to direct an impacting vehicle upwardly with an increased risk of overturning.

If the barrier were to have an outer surface which is planar in the vertical direction, the lower edge of the barrier which is in contact with the supporting surface, will have a greater resistance to lateral displacement than the remainder of the barrier under impact, thereby giving rise to a ramping effect under impact.

The barrier 12 of this invention as illustrated in FIGS. 1 and 2 of the drawings, is therefore adapted to provide a lesser impact resistance in the lower zone 30 than the impact resistance provided by the central impact zone 31 of the barrier above the lower zone 30.

In the embodiment illustrated in FIGS. 1 and 2, the lesser impact resistance of the lower zone is provided by each panel 14 having its lower zone 30 recessed inwardly relatively to the central impact zone 31.

In a preferred embodiment of the invention, the recessed lower zone may have a height of about 12 inches, which is less than the average height of a vehicle bumper, and a recessed depth of between about 5 and 10 inches.

By having the lower zones 30 laterally recessed relatively to the central impact zones 31, the lower zones 30 provide a lesser impact resistance and cannot come into contact with an impacting vehicle until substantial deformation of the impact zones of the panels 14 has occurred. This provides the advantage that not only will the ramping effect of the lower zones 30 be reduced but, if the lower zones 30 are deformed into a ramping configuration under impact, they will not come into contact with an impacting vehicle until its speed has been substantially attenuated by impact with the central impact zones 31 thereby substantially reducing, if not totally preventing, the generation of a ramping effect.

The recessing of the lower zones 30 further facilitates provision of the center of gravity of the barrier 12 at a height appropriate for the center of gravity of average vehicles striking the barrier 12.

In a preferred embodiment as illustrated in FIGS. 1 and 2, the lower zones 30 will be recessed sufficiently to insure that before the central impact zones 31 have been deformed sufficiently under impact to allow the lower zones 30 to come into contact with an impacting vehicle under high impacts, preferential lateral displacement of the barrier as a whole will occur thereby effectively combatting any ramping effect being provided by the lower zone 30.

Figure 3:
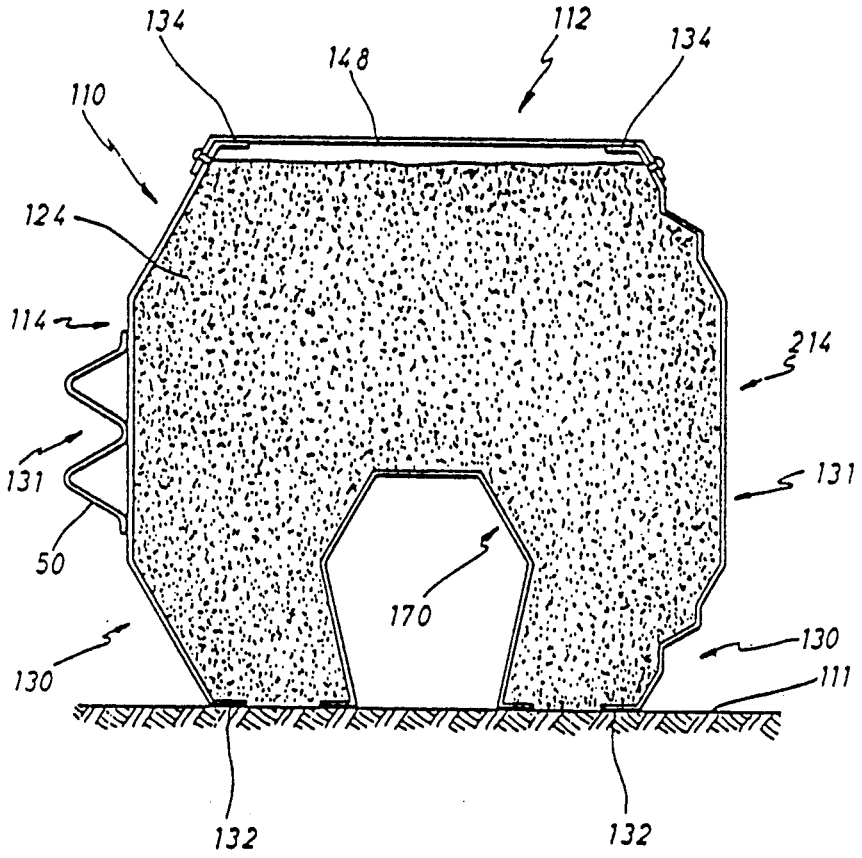
FIG. 3 shows a diagramatic end elevation of an alternative embodiment of apparatus in accordance with this invention, in an assembled condition and containing a stabilized filler material. For ease of illustration, two alternative types of panels defining opposed sides of the roadway barrier are illustrated.

The roadway barrier 12 is designed to house a stabilized filler material between the opposed panels 14. The stabilized filler material is shown in FIG. 3 of the drawings, but has been omitted from FIGS. 1 and 2 of the drawings for the sake of clarity.

The stabilized filler material is preferably sand, which has been stabilized with a bonding agent in the form of cement. The filler material has been stabilized to provide a shear strength for the stabilized filler material of between about 50 to 70 psi, while maintaining the compressive strength of the stabilized filler material below about 250 psi.

By providing a stabilized filler material with these properties, the elongated beam strength of the barrier 12 is increased to allow resistance to impact to build up quickly along the length of the barrier 12 thereby combatting penetration of the barrier 12 by an impacting vehicle and thereby permitting pivotal displacement of a vehicle under impact and thus smooth redirection of such a vehicle along the length of the barrier 12.

By providing a stabilized filler material instead of a non-stabilized filler material, the area of the barrier which is acted upon during an impact, is increased. This can therefore reduce the tendency for a vehicle to ramp the barrier under impact. By increasing the shear strength of the filler material, the beam strength of the barrier is increased to extend the area of the barrier which is acted upon during impact, while maintaining a sufficiently low compressive strength to absorb impact energy and to allow for deformation to minimize damage to impacting vehicles and particularly to occupants of such vehicles.

The stabilized filler material will allow a net deflection at the point of impact. This net deflection can be a combination of the stabilized filler material crushing under impact and the barrier 12 shifting laterally under impact.

By using a stabilized filler material in place of a non-stabilized filler material, the height and width of the barrier can be reduced while maintaining substantially equivalent operating characteristics to a barrier employing non-stabilized filler materials.

By using stabilized filler materials, the barrier 12 can be deformed under impact to gradually attenuate vehicle speed while the barrier remains sufficiently light to facilitate handling during transportation and erection.

Each panel has a height of about 42 inches and a length of 10½ feet, while the rows 16 and 18 are spaced internally to provide a maximum width of about 40 inches for the barrier 12.

Each panel 14 has an inturned flanged 32 along its lower edge 20 which is directed inwardly during use, each lower flange 32 being such as to be capable of being engaged by the displaceable ballast material when housed in the filler cavity 22 to support the pairs of panels 14 of each barrier component and restrain lifting of the panels 14 relatively to the supporting surface 11 under impact and thus restrain overturning of the portion of the barrier 12 under impact during use.

Each lower flange 32 further serves to reinforce each panel 14 longitudinally.

Each panel 14 further has an inwardly directed longitudinal stiffening flange 34 along its upper edge.

Each panel 14 further has panel fitting zones in the form of fitting apertures 35 formed in the panels 14 at opposed ends for cooperating with the panel connection means 26.

The sets of panel fitting apertures 35 at opposed ends of each panel 14 are arranged complementarily to each other to allow mating with sets of panel fitting apertures 35 of a corresponding panel 14 when positioned at either end of that panel.

When the panels 14 are assembled, each panel 14 has its one edge containing the apertures 35, marginally overlapped with the adjacent edge of the succeeding panel 14 thereby insuring that there are no gaps between adjacent panels 14 in the rows 16 and 18, and thereby insuring that the rows 16 and 18 will present a surface which is smooth and free of outwardly projecting obstructions in the direction of traffic flow in the adjacent highway. It follows that overlapping of the panels 14 will be in opposed directions in the two rows 16 and 18 for opposed flow in the two adjacent highways flanking the barrier 12 provided along the highway median.

In the embodiment illustrated in FIGS. 1 and 2, the panel connection means 26 comprises a bulkhead panel 36 for each pair of panels 14 of each barrier component of the barrier 12.

Each bulkhead panel 36 is made of sheet material, conveniently sheet metal, and has its opposed sides which extend vertically during use, of complementary configuration to the overall configurations of the panels 14 to mate therewith for maintaining the pairs of panels 14 of each barrier component to their appropriate laterally spaced relationship.

Each bulkhead panel 36 has a sufficient tensile strength to maintain the pair of panels 14 of each barrier component substantially in their appropriate laterally spaced relationship even after impact. However, the bulkhead panels 36 have limited compression strength thereby permitting collapsing of the bulkhead panels 36 under impact thereby insuring that the panel connection means 26 will not, after impact, present obstructions which tend to project beyond the impact deformed surfaces of the panels 14. Thus the panel connection means 26 will not tend to interfere with smooth redirection of an impacting vehicle along the length of the barrier 12.

Each bulkhead panel 36 has its opposed vertical edges bent transversely to the plane of the panel to provide transversely extending flanges 38.

Each flange 38 is provided with apertures 39 which are complementary to the panel fitting apertures 35 for alignment therewith.

The panel connection means 26 further comprises, for each bulkhead 36, a pair of locking pins 40 and a plurality of locking brackets 42.

Each locking bracket 42 has an enlarged head portion 43, a shank 44 extending from the head portion 43 and an aperture 46 in each shank 44 for cooperating slidably with a locking pin 40.

In use, for assembly of the apparatus 10, the panels 14 will be positioned in their appropriate positions on a supporting surface 11 whereafter the panels 14 of adjacent barrier components will be overlapped to align their fitting apertures 35. A bulkhead panel 36 will then be positioned in the overlapped zone with its apertures 39 in alignment with the apertures 35. Locking brackets 42 will then be inserted through the aligned apertures, whereafter a locking pin 40 will be threaded through the aligned apertures 35 and 39 at the top of the barrier. 12, and then through the apertures 46 in the locking brackets 42. Thereafter overlapped panels 14 can be connected to the opposed side of the bulkhead panel 36 in the same way. This operation is continued with further sets of panels 14 until a barrier 12 of a desired length has been formed.

The assembled barrier 12 may then be filled with a stabilized filler material in the form of sand, which is stabilized with an appropriate proportion of cement.

In an alternative embodiment of the invention, in place of the locking pins 40, conventional bolts may be used for bolting the adjacent ends of adjacent panels together. In this embodiment of the invention, each bulkhead panel 36 may have its opposed edges which extend vertically during use, shaped to be complementary to the shape of the panels 14. Thus, these same conventional bolts can be used to bolt the panels 14 together, and at the same time to bolt the panels 14 to the bulkhead panels 36.

The barrier 12 further includes a lid panel 48 for each barrier component (as shown in FIG. 1).

Each lid panel 48 is shaped to cover a barrier component, and has a length corresponding to the length of the panels 14 so that the lid panels of successive barrier components will overlap.

Each lid panel 48 is provided with a pair of screws 50 which can be screwed into bores provided in the upper ends of the locking pins 40 to locate the lid. Panels 48 in position. Alternately, each lid panel may be attached directly to the upper flange 34 by means of a number of screws driven through field drilled holes in the lid panels 48 and in the upper flanges 34.

To demonstrate the effectiveness of a roadway barrier in accordance with this invention, applicants conducted a full scale impact test.

The test was performed using a roadway barrier of the type illustrated in FIGS. 1 and 2 (except that the panels and bulkhead panels were bolted together using bolts), and having a stabilized filler material in accordance with this invention. The roadway barrier used in the test had a length of 300 feet. It was made up of overlapping upper and lower panel sections so that each panel had a height of 46 inches and a length of 10½ feet. Each panel in fact had a length of 11½ feet. However, the panels are overlapped by 1 foot thereby giving an effective panel length in the erected barrier, of 10½ feet. The rows of panels were laterally spaced to provide a width of 44 inches for the barrier.

The full scale impact test was conducted using a fully laden (80,000 pound gross vehicle weight) tractor trailer traveling at 51 miles per hour and impacting at an angle of 15 degrees from parallel.

The test was an unqualified success since the tractor trailer was contained by the roadway barrier, and was smoothly redirected along the length of the roadway barrier while the tractor trailer remained upright.

The corresponding roadway barrier of U.S. Pat. No. 4,423,854, which is assigned to the same assignee as this application, was primarily designed as a roadway barrier for use with passenger vehicles and conventional trucks. That roadway barrier used a particulate filler material which was not stabilized.

The prior nonstabilized filler barrier was found to be extremely successful for the types of vehicles for which it had been designed. While it had on several occasions safely redirected large transport trucks impacting field installations, the nonstabilized barrier was not originally designed as a truck-specific system. Applicants believed, on the basis of accumulated experience, that under the extremely severe impact conditions called for in Federal Highway Authority Impact Test Guidelines, the nonstabilized barrier may not be able to contain an impacting 80,000 pound tractor trailer or truck.

Applicants were also aware of the fact that several highway authorities, particularly toll highway authorities, had identified a need for a barrier specifically designed to accommodate the largest trucks. Such authorities had begun to experiment with massive, heavily reinforced concrete barriers in an effort to provide reliable containment for trucks. Such massive, heavily reinforced concrete barriers had a very high cost and, if designed to be suitable for large trucks, would tend to provide severe damage for impacting light vehicles.

Based upon the results of impact tests of the prior nonstabilized fill barriers with buses (approximately 20,000 pound gross vehicle weight) and with a short chassis non-articulated transport of about 40,000 pound gross vehicle weight, applicants identified certain characteristics which would have to be increased and balanced to provide a successful truck barrier:

(a) Increased beam strength in the barrier assembly. The nonstabilized filler barrier is significantly inertial under severe impact conditions. A portion of the mass of inertial fill material is accelerated during the impact event and thus a resisting force is generated and applied to the impacting vehicle. However, under impact by a heavier vehicle, it is possible that a relatively short length of the barrier would be affected by the vehicle early during the impact event. Thus the mass which would be accelerated by the impact would represent a much smaller proportion of the vehicle's mass than in the case where the roadway barrier is struck by a passenger vehicle. Applicants thus believed that the resistive force applied to a heavy vehicle would have a diminished effect, possibly causing the barrier to fail to redirect larger vehicles. An increase in the overall beam stiffness of the entire assembly would mean that a greater length of barrier would be affected during the earliest stages of the impact. This means that a greater mass of the barrier would be engaged by the impact, thus increasing the resistive force applied by the barrier to the vehicle.

(b) Provide for a consistent and predictable lateral movement or sliding of the barrier. The laws of physics dictate that for any specific vehicle with a center of mass above the point of contact with a highway barrier, there is a limit to the magnitude of the force of interaction between barrier and vehicle which can be applied without the vehicle overturning. The magnitude of that force is reduced in inverse proportion to the distance over which the force is applied. In other words, a barrier which can "give" to some degree has an advantage over one which is completely rigid to reduce the likelihood of a vehicle being overturned during a particular impact. Based on the height of the roadway barrier, applicants believed that a certain amount of total translation, perhaps even several feet, of the barrier across the surface on which it rests, would make a clear difference in the success of the barrier system in eliminating or reducing the frequency of overturn during heavy vehicle accidents. Applicants believed therefore that the barrier should be designed so that it can be counted on to slide laterally for such a distance without damage which would otherwise compromise its performance.

(c) Torsional rigidity. For the barrier to continue to provide a reliable impact region as an impacting vehicle slides along the barier for as much as several hundred feet, the cross-section of the barrier should be substantially maintained throughout the impact event. Applicants observed that an increase in the torsional rigidity of the barrier structure would have the effect of keeping the principal impact region upright even under severe impact conditions. Applicants observed from tests with the prior barrier having the nonstabilized filler material, that one of the characteristics of the response of the barrier when impacted by a larger vehicle, was some lean of the impact face of the barrier in the upper part of the barrier towards the rear of the barrier. Applicants believed that under extreme conditions such lean could allow an impacting vehicle to overturn.

(d) The capacity to provide some vertical support for an impacting vehicle. For nearly any vehicle with a high center of mass (relative to the height of the barrier), there is a distinct tendency to lean towards the barrier during impact. In other words, under impact, there is a moment created which tends to rotate the impacting vehicle. If the barrier exhibits adequate translation, that is adequate lateral shifting under impact, the vehicle will have a tendency to remain upright. Nevertheless, with larger trucks, the degree of leaning which occurs under impact, tends to cause the impacting truck to apply a downward load onto the roadway barrier. Applicants believed that if the barrier could accept and support the downward load applied to the top of the barrier by, for example, the underside of the bed of the impacting trailer, the barrier would better support the impacting truck against overturning.

To obtain these characteristics, applicants tried to improve the structural components of the barrier. This included providing additional stiffeners to increase the beam stiffness of the barrier, and providing structural lids and undertrays to increase torsional stiffness and to provide a reliable sliding surface on the underside of the barrier. However, applicants noted that the addition of these supplemental components would add a great deal to the cost of production of the barrier, and greatly increase the difficulty of assembly of the barrier thus further increasing the final installed cost of the barrier.

Applicants then began searching for alternative ways to achieve what they perceived as the desired characteristics for a roadway barrier to contain larger vehicles.

Applicants were aware of the substantial disadvantages provided by roadway barriers of the concrete type. Applicants were particularly aware of the substantial damage which can be caused to vehicles and passengers due to the rapid deceleration of impacting vehicles, and to the sharp redirection of impacting vehicles by such barriers. Applicants therefore rejected the idea of using conventional concrete in the roadway barriers.

After continuing to search for solutions, applicants conceived of the concept of using a stabilized fill material which would be stabilized to provide an increased beam strength and an increased compressive strength over the nonstabilized filler material, but would have a compressive strength which would be lower than that of concrete to offset the harmful and dangerous characteristics of concrete roadway barriers. The stabilized filler material would also be cheaper than concrete.

This led to a series of investigations cf the concept of stabilizing filler materials to differing degrees to achieve differing shear strengths and differing compressive strengths.

In order to try the concept of utilizing stabilized filler material, applicants determined to conduct preliminary impact tests on a smaller, more economical scale than a full impact test using 80,000 pound trucks. Applicants made a "half-sized" barrier filled with unstabilized filler material. A test was conducted with this barrier using a large automobile weighing approximately 4,500 pounds at a speed of 60 miles per hour and a 15 degree impact angle to the parallel. The purpose of this test was to establish a baseline against which to compare the results of a subsequent test in which stabilized fill was used. As expected, the impacting vehicle was lifted into the air by the barrier and continued right over the barrier after being airborne for some distance.

Applicants then conducted a successful test with the half-sized roadway barrier having a stabilized filler material. The test was successful in providing a perfect redirection of an impacting 4,500 pound automobile. This test also demonstrated the benefit of the use of a stabilized fill over the prior test with the same size barrier and a nonstabilized fill, where the same type of 4,500 pound automobile had been lifted by the impact and had traveled completely over the barrier after being in the air for a number of feet along the length of the barrier.

The filler material used in this test had a strength of approximately 600 psi in compression. This compressive strength was chosen as a conservative choice even though applicants believed that a lower compressive strength would be adequate for the test in question.

After this successful test, a test with the roadway barrier of the type illustrated in FIGS. 1 and 2, was scheduled with the 80,000 pound gross weight tractor trailer.

The roadway barrier was arranged in a 300 foot length and was filled with a stabilized sand stabilized with cement. The fill material was compacted somewhat more firmly than previously so that the stabilized filler material had a compressive strength of slightly more than 1,000 psi. The test was a complete success. The 80,000 pound tractor trailer was smoothly redirected along the length of the barrier. It remained upright and the cab was essentially undistorted despite substantial damage to the tractor. The smoothly redirected vehicle continued sliding along the barrier until it eventually came to rest towards the end of the 300 foot length of barrier. The barrier itself not only survived, but could possibly have accepted a repeat impact at the same point. The peak lateral translation of the barrier in the zone of direct impact was less than two feet, but otherwise the damage was slight.

Applicants concluded from this test that it would be beneficial to use a weaker filler material within the barrier for optimum performance because that would allow some additional translation of the barrier and would thus reduce the amount of lean of the vehicle against the barrier during the impact event. Applicants further believe that a somewhat weaker material would show more localized crushing and this would thereby reduce the impact forces on the vehicle. This test led applicants to believe that a fill material having less than half the strength of the fill material used in the test, would be adequate to handle such an impact.

From theoretical analysis of the barrier requirements, applicants have calculated that a shear strength of about 118 psi (corresponding to approximately 700 psi compressive strength) would be appropriate for a tractor trailer of this type. This calculation recognizes only the composite action of the stabilized filler material and the barrier structure. It does not assume any translation of the barrier, does not account for the independent beam strength of each side of the barrier structure, and does not account for the independent strength of the stabilized filler material. Thus the figure of about 118 psi in shear strength, is probably a very conservative figure.

Applicants believe therefore that to properly contain vehicles of this size in a consistent manner, while limiting damage to the impact vehicle and its occupants, a stabilized filler material having a compressive strength of less than 500 psi (which would correspond approximately to a shear strength of 85 psi, depending upon the specific material used) would be appropriate.

Applicants believe that by selecting the appropriate filler material, and stabilizing the filler material to provide an appropriate minimum shear strength and an appropriate maximum compressive strength, the roadway barrier of this invention can be designed to accommodate conventional automobiles, a desired mix of automobiles and large trucks, or can be designed to be specific for a large volume of large trucks.

With reference to FIG. 3 of the drawings, reference numeral 112 generally to an alternative embodiment of apparatus in accordance with this invention for forming an alternative form of roadway barrier 112.

The barrier 112 corresponds generally with the barrier 12 and corresponding parts are corresponding reference numerals except that the prefix "1" has been included in the reference numerals for ease of reference.

The barrier 112 includes additional means for ensuring that the barrier 112 has a lower zone 130 which has a resistance to displacement under impact which is less than that of a central impact zone 131 of the barrier 112 above the lower zone.

In the barrier 112, the barrier includes collapsing means 170 for causing preferential collapsing of the lower zone 130 under impact.

The collapsing means 170 comprises a hollow tubular collapsing member which is placed on the support surface 111 along the central region of the barrier 112 prior to placing the filler material 124 in the filler cavity 122.

The filler material 124 is in the form of sand which is mixed with the appropriate proportion of cement to provide the required shear strength while maintaining the compressive strength below the prescribed limits. Once the stabilized filler material mixture has been formed, it can have the appropriate quantity of water added thereto, and can then be poured into the filler cavity between the opposed pairs of panels 14.

In FIG. 3 the panels along opposed sides of the barrier 112 have been shown in two alternative forms. This has been done for convenience only since, in practice, the panels of a barrier will usually be corresponding.

The panels along one side of the barrier have been indicated by reference numeral 114, whereas those along the opposed side of the barrier have been indicated by reference numeral 214.

The panels 114 have a profile in the vertical direction to provide a central zone of each panel which bulges outwardly to provide the primary impact zone 131 for an impacting vehicle. In addition, the impact zone 131 is reinforced by means of a W-section panel 150 which is mounted thereon.

The panels 214 have a similar bulge but differ in that they are not provided with reinforcing panels. However, corrugations are provided between the bulging portion and the upper and lower portions of the panels to facilitate collapsing of the panels 214 under impact.

Figure 4:
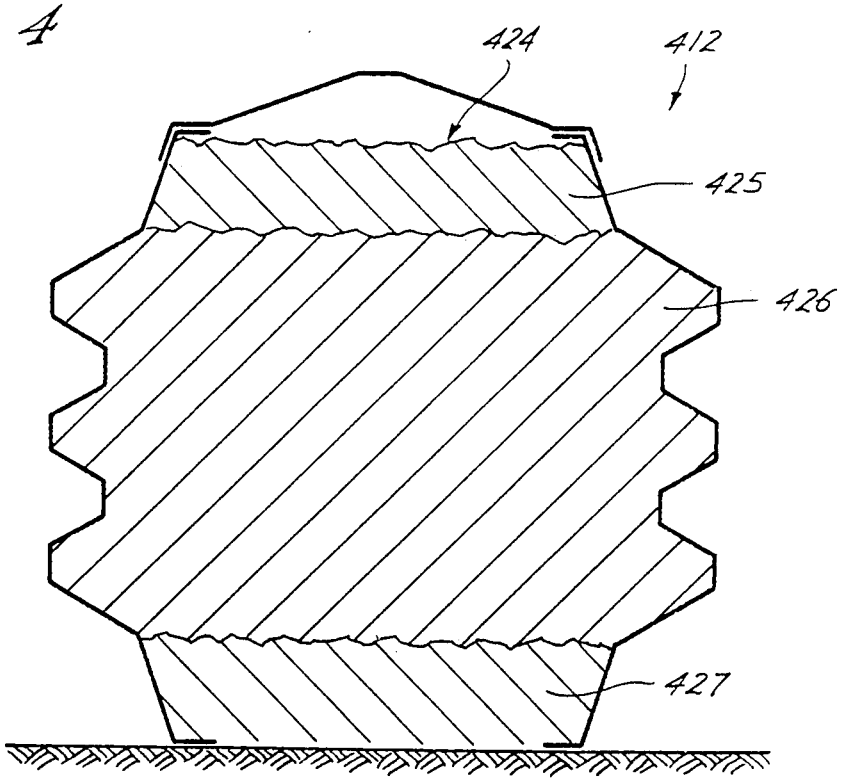
FIG. 4 shows a diagramatic end elevation of an alternative embodiment of a roadway barrier in accordance with this invention.

With reference to FIG. 4 of the drawings, reference numeral 412 refers to yet a further alternative embodiment of a roadway barrier in accordance with this invention.

Figure 5:
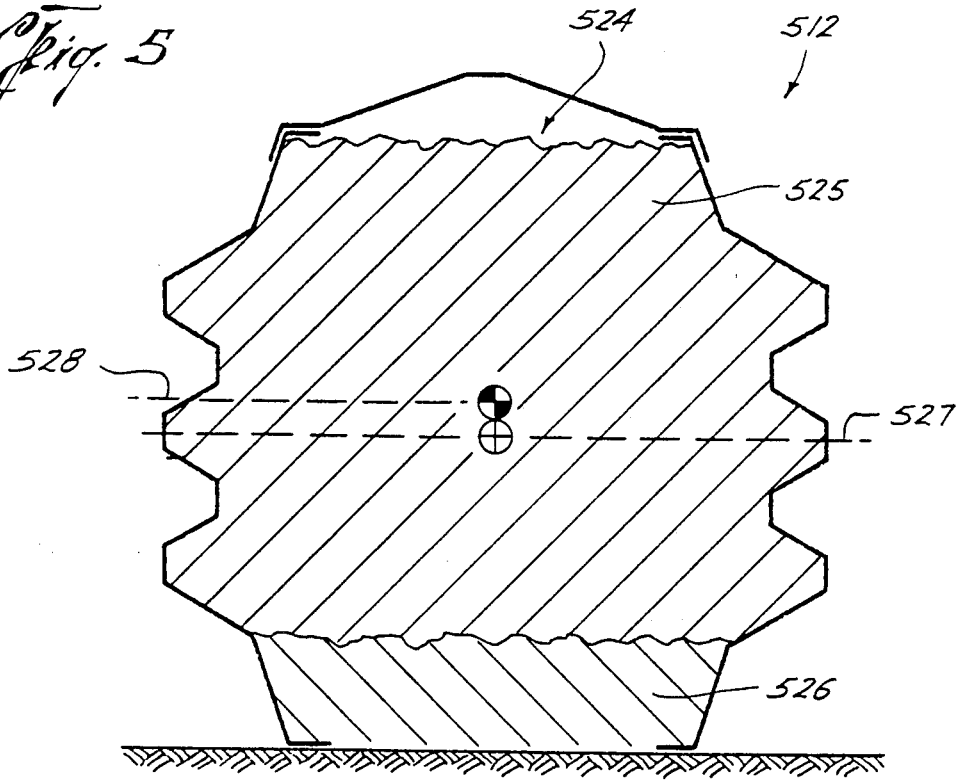
FIG. 5 shows a diagramatic end elevation of yet a further alternative embodiment of a roadway barrier in accordance with this invention.
Figure 6:
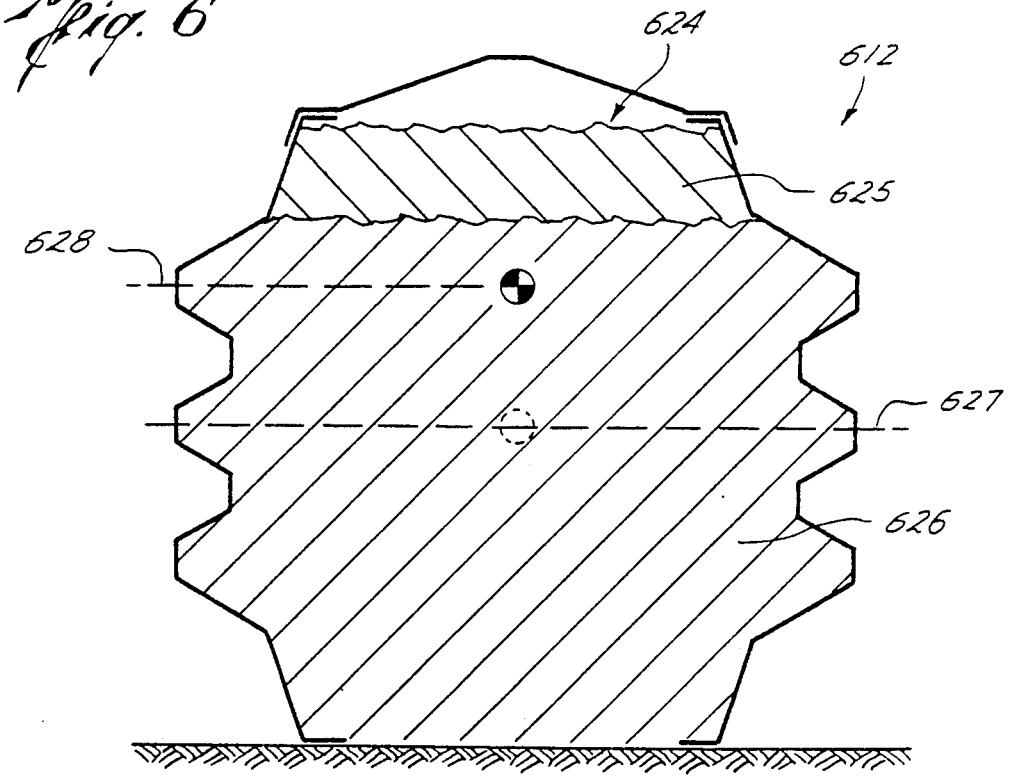
FIG. 6 shows a diagramatic end elevation of yet a further alternative embodiment of a roadway barrier in accordance with this invention.
Figure 7:
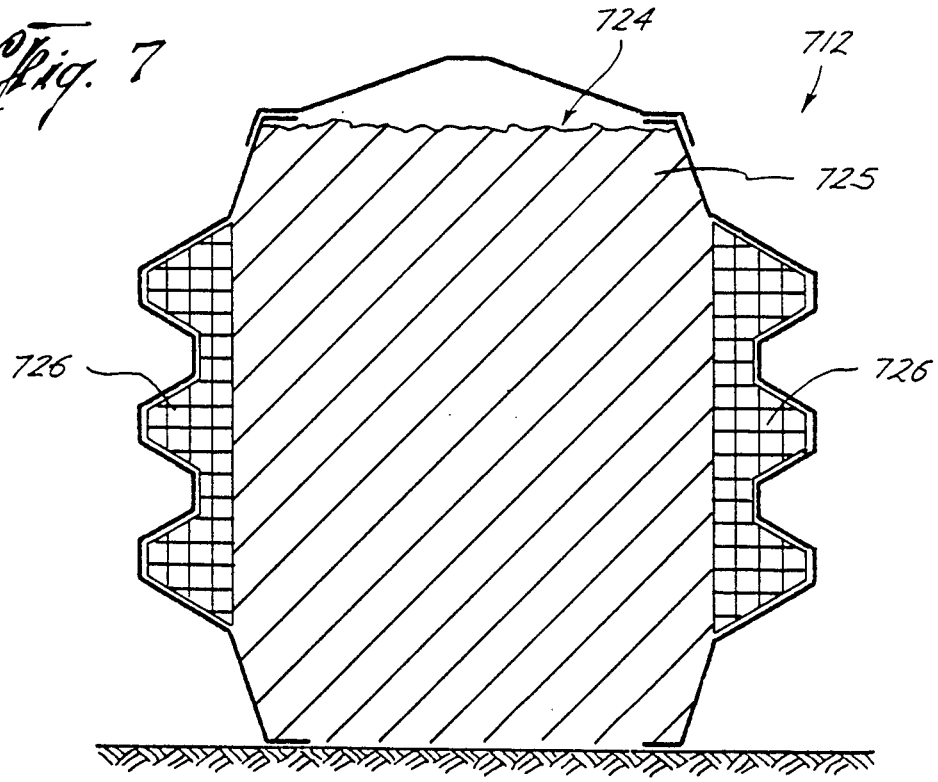
FIG. 7 shows a diagramatic end elevation of yet a further alternative embodiment of a roadway barrier in accordance with this invention.

The roadway barrier 412 corresponds with the roadway barrier indicated in FIGS. 1–3, except that the stabilized filler material 424 differs. Therefore, only the stabilized filler material is discussed with reference to FIG. 4. FIGS. 5, 6 and 7 relate to FIGS. 1 and 2 in the same way as FIG. 4. Thus, in connection with FIGS. 5–7, likewise the stabilized filler material will be discussed in detail.

In FIG. 4 of the drawings, the filler material 424 is provided in three vertically spaced layers 425, 426 and 427. The central layer 426, which constitutes the principal impact region, is filled with a stabilized filler material which has a substantially lower shear strength than the stabilized filler material filling the upper layer 425 and the lower layer 427.

With such an arrangement, the barrier 412 will deflect relatively easily under impact until deformation of around 8 inches or so has occurred. At this point the impacting vehicle will begin to experience the influence of the less crushable upper and lower layers 425 and 427. This arrangement is advantageous for impacts with automobiles since it is desirable that localized crushing must be able to occur to absorb impact energy and thereby minimize damage.

In the barrier 412, the layering can allow for a more forgiving barrier, at least at lower levels of impact severity, while retaining tee significantly increased beam stiffness of the filled barrier 412 when viewed as a single composite structure. However, should a large vehicle strike the barrier at high speed and angle, the wheels and body structure of the vehicle will engage the more rigid regions which are at higher shear strength, once the principal impact region has expended its initial, relatively low resistance to deformation.

The very rigidity and shear strength of the layers 425 and 427 means that there will be a greater degree of resistance to localized deformation. Thus, the impacting part of the vehicle will tend to push the entire barrier 412 away rather than penetrate the stabilized barrier or override the lower portion of the barrier 412.

This provides advantages for accommodating impacts by larger vehicles such as trucks. By shifting laterally under impact from a large truck, the barrier is more able to redirect such an impacting truck without the truck overturning. Furthermore, this arrangement provides for a more durable platform for an impacting truck to lean on during redirections. In particular, the underside of the bed of most truck trailers will have a tendency to rest upon the top of the barrier during impact. A more rigid filler in the upper region will serve to minimize the structure of the truck biting into the top of the barrier and causing potentially hazardous snagging.

For this embodiment of the invention, the central region may be stabilized to provide a shear strength of about 10 to 30 psi, while the upper and lower layers 425 and 427 may be stabilized to provide a shear strength of 55 to 75 psi. The compressive strengths of the upper and lower layers 425 and 427 will be correspondingly higher than the compressive strength of the primary impact-absorbing central layer 426.

With reference to FIG. 5 of the drawings, the roadway barrier 512 has the filler material 524 arranged in two vertically spaced layers 525 and 526.

The upper layer 525 uses more dense filler material to increase the density of the upper layer 525, whereas the lower layer 526 contains a less dense filler material. Indeed the layer 526 may be a nonstabilized layer.

Providing the layer 525 having a higher density than the layer 526, the height of the center of mass of the barrier will be elevated from the position indicated by dotted line 527 to the position indicated by the dotted line 528. By raising the height of the center of mass of the barrier, the torsion on the barrier due to impact loading can be reduced. This can provide the advantage of reducing the likelihood of an impact producing a ramp effect.

With reference to FIG. 6 of the drawings, reference numeral 612 refers to a further alternative embodiment of a roadway barrier, again having the filler material 624 arranged in two vertically spaced layers 625 and 626.

The layer 625 is a denser material than the layer 626. The layer 625 also includes a greater proportion of bonding agent and therefore provides a greater shear strength than the layer 626.

In this embodiment of the invention, the center of gravity of the barrier 612 can be raised from the position indicated by dotted line 627 (where a single stabilized filler material is used) to the position indicated by dotted line 628 where the layered configuration is used.

Because of the increase in beam strength provided by the stabilized filler material, the barrier 612 is less dependent on the absolute linear density (mass per unit of length) to provide an effective functioning roadway barrier system. The overall rigidity provided by the stabilized filler material in the barrier 612 means that the mass of a quite considerable length of barrier can be brought into play very early in the chronology of an impact. The upper layer 625 may therefore have a cure density as high as 125 pounds per cubic foot, whereas the lower layer 626 may have a cure density of as little as 25 pounds per cubic foot. This could, for example, be achieved by using a lightweight vermiculite concrete in the lower layer 626, and by using a sand stabilized with cement as the upper layer 625.

Embodiments of this aspect of the invention, can raise the center of mass of the barrier to an elevated position, thereby providing more effective accommodation of impacts from larger vehicles and trucks.

With reference to FIG. 7 of the drawings, reference numeral 712 refers to yet a further alternative embodiment of a roadway barrier in accordance with this invention. arranged in three horizontally spaced layers 725 and 726.

The layer 725 is a stabilized filler material which has a relatively higher shear strength and relatively higher compressive strength than the two layers 726.

The layer 726 are therefore more crushable under impact to absorb the impact energy. Once the initial impact energy has been absorbed, the layer 725 with its higher shear strength, will come in to play to assist in smoothly and gradually redirecting the impact vehicle along the length of the barrier.

In the embodiment of FIG. 7, the layer 725 may conveniently provide a shear strength of between 40 and 60 psi, with a compressive strength of about 250 psi, whereas the layer 726 may provide a shear strength of about 20 psi, and a compressive strength of about 125 psi or less.

The layer 726 may be formed by using preformed insets or by using form-work which is left in place.

Shear strengths and compressive strengths of stabilized filler materials are capable of reasonably accurate measurement.

The stabilized filler materials can therefore be designed experimentally to provide appropriate shear strengths and appropriate compressive strengths for the designed roadway conditions, vehicle sizes, and vehicle speeds.

By using a stabilized filler material in accordance with this invention, the rear panels of the barrier (i.e. those on the opposite side of the impact area) are in effect put in tension by the filler material during impact. By virtue of this tension, the panels in combination with the stabilized filler material tend to provide an increased beam strength over a barrier using unstabilized filler material. In addition, the stabilized filler material contributes to the beam strength of the barrier. Applicants believe, therefore, that it may be possible to reduce the thickness of the material from which the panels are made and still have a barrier with equivalent performance.

Since the cost of the steel is a major component of the cost of the panels, the cost can be reduced by using a thinner material.

Applicants believe, therefore, that the material of the panels can be reduced in thickness down to say 16 or 18 gauge steel. The limiting factor on the reduction of thickness will tend to be the tendency for puncturing to occur during impact.

While the presently preferred filler material is sand, various types of filler materials can be used provided that they can be stabilized with an appropriate bonding agent, to provide the necessary characteristics. By using conventional technology, a range of various types of filler materials can be stabilized using appropriate bonding agents, to provide appropriate characteristics. For example, earth may be used as the filler material and may conveniently be stabilized using a cementitious material. Some types of soils may require compaction during stabilization to provide the required characteristics. In roadway construction, by using the soils on site, a roadway barrier can be provided with appropriate characteristics and without the costs involved in transporting the filler materials from remote sites. This can be important in reducing the cost of the installed roadway barrier.

It will be appreciated that various modifications and alterations can be made to these specific features of the invention without departing from the essential concepts of this invention.

In the claims:

1. An elongated roadway barier, positioned on a supporting surface of flank a roadway, the barrier being deformable under impact to redirect a straying vehicle striking the barrier, the barrier comprising:

(a) a plurality of panels arranged in two generally parallel spaced rows along lower edges of the panels to define a filler cavity between them;

(b) connection means engaged with the panels thereby locating the rows in their laterally spaced relationship, and connecting the panels in each row in end-to-end relationship in an elongated linked row with the barrier presenting an outer surface along at least a first side of the barrier which surface is generally smooth in a direction parallel to the length of the barrier to allow a vehicle striking the barrier to be deflected along the barrier;

(c) a filler material housed in the filler cavity to support the barrier and provide a medium for dissipating impact energy;

(d) the filler material being at least one layer of non-stabilized filler material and at least one layer of a stabilized filler material, said stabilized filler material is stabilized by means of a bonding agent;

(e) the stabilized filler material providing a shear strength for the stabilized filler material of at least about 10 to 15 psi to provide beam strength for the barrier to distribute an impact force along the length of the barrier; and (f) the stabilized filler material having a compressive strength of less than about 1200 psi to permit deformation of the barrier under impact to absorb impact energy.

2. A barrier according to claim 1, in which the panels along a second side of the barrier also present an outer surface which is generally smooth in a direction parallel to the length of the barrier to allow a vehicle striking the second side of the barrier to be deflected along the barrier.

3. A barrier according to claim 1, in which the panels on at least one side of the barrier each have a central impact zone which is bulged outwardly relative to its upper and lower zones to form a primary impact zone.

4. A barrier according to claim 3, in which the central impact zone comprises corrugation formations along the central impact zone.

5. A barrier according to claim 1, in which each panel has an inturned lower flange proximate its lower edge to be directed inwardly during use.

6. A barrier according to claim 5, in which each lower flange is such as to be capable of being engaged by the filler material to restrain lifting of the panels of the barrier under impact.

7. A barrier according to claim 1, in which each panel has an inwardly directed upper stiffening flange along its upper edge.

8. A barrier according to claim 7, in which the barrier includes elongated lid panels which close the upper surface of the barrier.

9. A barrier according to claim 1, in which the connection means comprises a plurality of bulkhead panels, each bulkhead panel having opposed sides which are connected to the panels in the opposed rows.

10. A barrier according to claim 1, in which the filler material is stabilized to provide a shear strength of at least about 20 to 30 psi.

11. A barrier according to claim 1, in which the filler material is stabilized to provide a shear strength of at least about 40 psi.

12. A barrier according to claim 1, in which the filler material is stabilized to provide a shear strength of between about 40 psi and about 80 psi.

13. A barrier according to claim 1, in which the filler material is stabilized to provide a shear strength of between about 50 and about 70 psi.

14. A barrier according to claim 1, in which the filler material is stabilized to provide a shear strength of between about 30 and about 200 psi.

15. A barrier according to claim 14, in which the filler material is stabilized to provide a shear strength of between about 30 and about 135 psi.

16. A barrier according to claim 14, in which the filler material is stabilized to provide a shear strength of between about 65 and about 135 psi.

17. A barrier according to claim 14, in which the filler material is stabilized to provide a shear strength of between about 85 and about 120 psi.

18. A barrier according to claim 14, in which the filler material is stabilized to provide a shear strength of between about 60 and about 120 psi.

19. A barrier according to claim 1 or claim 13, in which the stabilized filler material has a compressive strength of less than about 250 to 350 psi.

20. A barrier according to claim 1 or claim 13, in which the stabilized filler material has a compressive strength of less than about 150 to 200 psi.

21. A barrier according to claim 1 or claim 13, in which the stabilized filler material has a compressive strength of less than about 125 psi.

22. A barrier according to claim 1 or claim 15, in which the stabilized filler material has a compressive strength. of less than about 1000 psi.

23. A barrier according to claim 1 or claim 15, in which the stabilized filler material has a compressive strength of less than about 800 psi.

24. A barrier according to claim 1 or claim 15, in which the stabilized filler material has a compressive strength of between about 400 and 800 psi.

25. A barrier according to claim 1 or claim 15, in which the stabilized filler material has a compressive strength of between about 500 and 700 psi.

26. A barrier according to claim 1 or claim 15, in which the stabilized filler material has a compressive strength of between about 200 and 400 psi.

27. A barrier according to claim 1, in which the filler material comprises sand, and in which the bonding agent comprises a cementitious agent.

28. A barrier according to claim 1, having a filler material arranged in the filler cavity in a plurality of elongated layers which extend along the length of the barrier, the filler material in at least one of the layers being the stabilized filler material.

29. A barrier according to claim 28, in which at least one layer is a nonstabilized filler material.

30. A barrier according to claim 28, in which the elongated layers are arranged in substantially vertically spaced relationship.

31. A barrier according to claim 28, in which the elongated layers are arranged in substantially horizontally spaced relationship.

32. A barrier according to claim 28, in which filler materials in different layers are stabilized to differing extents to provide differing shear strengths and differing compressive strengths.

33. A method of improving the operating characteristics of a roadway barrier of a type comprising a plurality of panels which are arranged in two generally parallel spaced rows along their lower edges to define a filler cavity between them, with the panels being connected by means of connection means which locate the rows in their laterally spaced relationship and which connect the panels in each row in end-to end relationship in an elongated linked row, with the barrier being deformable under impact to redirect a straying vehicle along the length of the barrier, the method comprising providing at least one layer of a stabilized filler material and at least one layer of non-stabilized filler material in the filler cavity, the stabilized filler material providing a shear strength of at least about 10 to 15 psi and having a compressive strength of less than about 1200 psi.

34. A method according to claim 33, in which the stabilized filler material provides a shear strength of between about 30 and 140 psi, and a compressive strength of between about 200 and 800 psi.

35. A method according to claim 33, in which the stabilized filler material provides a shear strength of between about 65 and 120 psi, and a compressive strength of between about 400 and 700 psi.

36. A method of reducing the mass of a roadway barrier and increasing the beam strength of a roadway barrier of the type which is deformable under impact and comprises two substantially parallel rows of elongated panels which are connected together in laterally spaced relationship, with the panels in each row being connected together in end-to-end relationship, and which has a filler material between the laterally spaced panels to provide a medium for absorbing impact energy during use and for supporting the panels, which comprises a non-stabilized filler material and at least one layer of stabilized filler material which is stabilized with a bonding agent to provide a shear strength of at least about 15 to 25 psi for the stabilized filler material, while limiting the compressive strength of the stabilized filler material to less than about 1200 psi.

37. A method according to claim 36, in which the filler material is stabilized to provide a shear strength of between about 45 and about 75 psi, while the compressive strength is limited to less than about 250 psi.

38. A method according to claim 36, in which the filler material is stabilized to provide a shear strength of between about 30 and about 140 psi, while the compressive strength is limited to less than about 800 psi.

39. A method according to claim 36, in which the filler material is stabilized to provide a shear strength of between about 65 and about 120 psi, while the compressive strength is limited to less than about 700 psi.

* * * * *